US012215479B2

(12) United States Patent
Oasa

(10) Patent No.: US 12,215,479 B2
(45) Date of Patent: Feb. 4, 2025

(54) WORK EQUIPMENT CONTROL DEVICE, WORK VEHICLE, AND METHOD FOR CONTROLLING WORK EQUIPMENT

(71) Applicant: KOMATSU LTD., Tokyo (JP)

(72) Inventor: Takahisa Oasa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 556 days.

(21) Appl. No.: 17/419,525

(22) PCT Filed: Apr. 1, 2020

(86) PCT No.: PCT/JP2020/015116

§ 371 (c)(1),
(2) Date: Jun. 29, 2021

(87) PCT Pub. No.: WO2020/204110

PCT Pub. Date: Oct. 8, 2020

(65) Prior Publication Data

US 2022/0081871 A1 Mar. 17, 2022

(30) Foreign Application Priority Data

Apr. 4, 2019 (JP) ..... 2019-072104

(51) Int. Cl.
*E02F 3/43* (2006.01)
*E02F 3/28* (2006.01)
(Continued)

(52) U.S. Cl.
CPC ..... *E02F 3/434* (2013.01); *E02F 9/2041* (2013.01); *E02F 3/283* (2013.01); *E02F 9/2004* (2013.01); *E02F 9/2228* (2013.01); *E02F 9/2296* (2013.01)

(58) Field of Classification Search
CPC ..... E02F 3/434; E02F 9/2041; E02F 3/283; E02F 9/2004; E02F 9/2228; E02F 9/2296
See application file for complete search history.

(56) References Cited

U.S. PATENT DOCUMENTS 5,537,818 A 7/1996 Hosseini et al.
6,371,214 B1 4/2002 Anwar et al.
(Continued)

FOREIGN PATENT DOCUMENTS

CN 204530812 U 8/2015
JP 8-209749 A 8/1996
(Continued)

OTHER PUBLICATIONS

The International Search Report for the corresponding international application No. PCT/JP2020/015116, issued on Jun. 30, 2020.

*Primary Examiner* — Andrew J Cromer
(74) *Attorney, Agent, or Firm* — Global IP Counselors, LLP

(57) ABSTRACT

A work equipment control device of a work vehicle includes state determination unit and an automatic dump determination unit. The state determination unit determines a work state of the work vehicle based on a traction force of the work vehicle and a posture of work equipment. An automatic dump determination unit determines an automatic dump availability mode indicating the availability in performing automatic dump control for automatically driving a bucket to a predetermined dump angle, in accordance with the work state.

12 Claims, 6 Drawing Sheets

(51) Int. Cl.
*E02F 9/20* (2006.01)
*E02F 9/22* (2006.01)

(56) References Cited

U.S. PATENT DOCUMENTS

| | | | | |
|---|---|---|---|---|
| 9,790,660 | B1 | 10/2017 | Marquette et al. | |
| 2014/0129093 | A1* | 5/2014 | Shirao | E02F 3/433 701/50 |
| 2018/0119384 | A1* | 5/2018 | Imaizumi | E02F 3/439 |
| 2020/0277757 | A1* | 9/2020 | Kurokami | E02F 9/24 |

FOREIGN PATENT DOCUMENTS

| | | | |
|---|---|---|---|
| JP | 8-326091 | A | 12/1996 |
| JP | 11-286969 | A | 10/1999 |
| JP | 5228132 | B1 | 7/2013 |

* cited by examiner

WORK EQUIPMENT CONTROL DEVICE, WORK VEHICLE, AND METHOD FOR CONTROLLING WORK EQUIPMENT

CROSS REFERENCE TO RELATED APPLICATION(S)

This application is a U.S. National stage application of International Application No. PCT/JP2020/015116, filed on Apr. 1, 2020. This U.S. National stage application claims priority under 35 U.S.C. § 119(a) to Japanese Patent Application No. 2019-072104, filed in Japan on Apr. 4, 2019, the entire contents of which are hereby incorporated herein by reference.

BACKGROUND

Field of the Invention

The present invention relates to a work equipment control device, a work vehicle, and a method for controlling work equipment.

Background Information

In a work vehicle such as a wheel loader, automatic drive control (detent control or kick-out control) is performed to automatically drive work equipment to a predetermined position in order to easily and accurately perform a repeated operation of the work equipment to the predetermined position.

U.S. Pat. No. 9,790,660 discloses a technique of determining the availability of the automatic drive control based on a load state of the work equipment specified from a load applied to the work equipment.

SUMMARY

Automatic drive control can be performed for each of four operations of boom raising, boom lowering, bucket tilting, and bucket dumping. However, when a work object is accommodated in a bucket, if the automatic drive control relating to the bucket dumping is performed due to an erroneous operation, there is a possibility that the work object may fall.

An object of the present invention is to provide a work equipment control device, a work vehicle, and a method for controlling work equipment capable of preventing a work object from falling due to automatic drive control.

According to an aspect of the present invention, a work equipment control device of a work vehicle including work equipment having a boom and a bucket is provided, the work equipment control device including a state determination unit that determines a work state of the work vehicle, and an automatic dump determination unit that determines an automatic dump availability mode indicating the availability in performing automatic dump control for automatically driving the bucket to a predetermined dump angle, in accordance with the work state.

According to the above-described aspect, the work equipment control device prevents the work object from falling due to automatic drive control.

DETAILED DESCRIPTION OF EMBODIMENT(S)

First Embodiment

Hereinafter, an embodiment will be described in detail with reference to the drawings.

Figure 1:
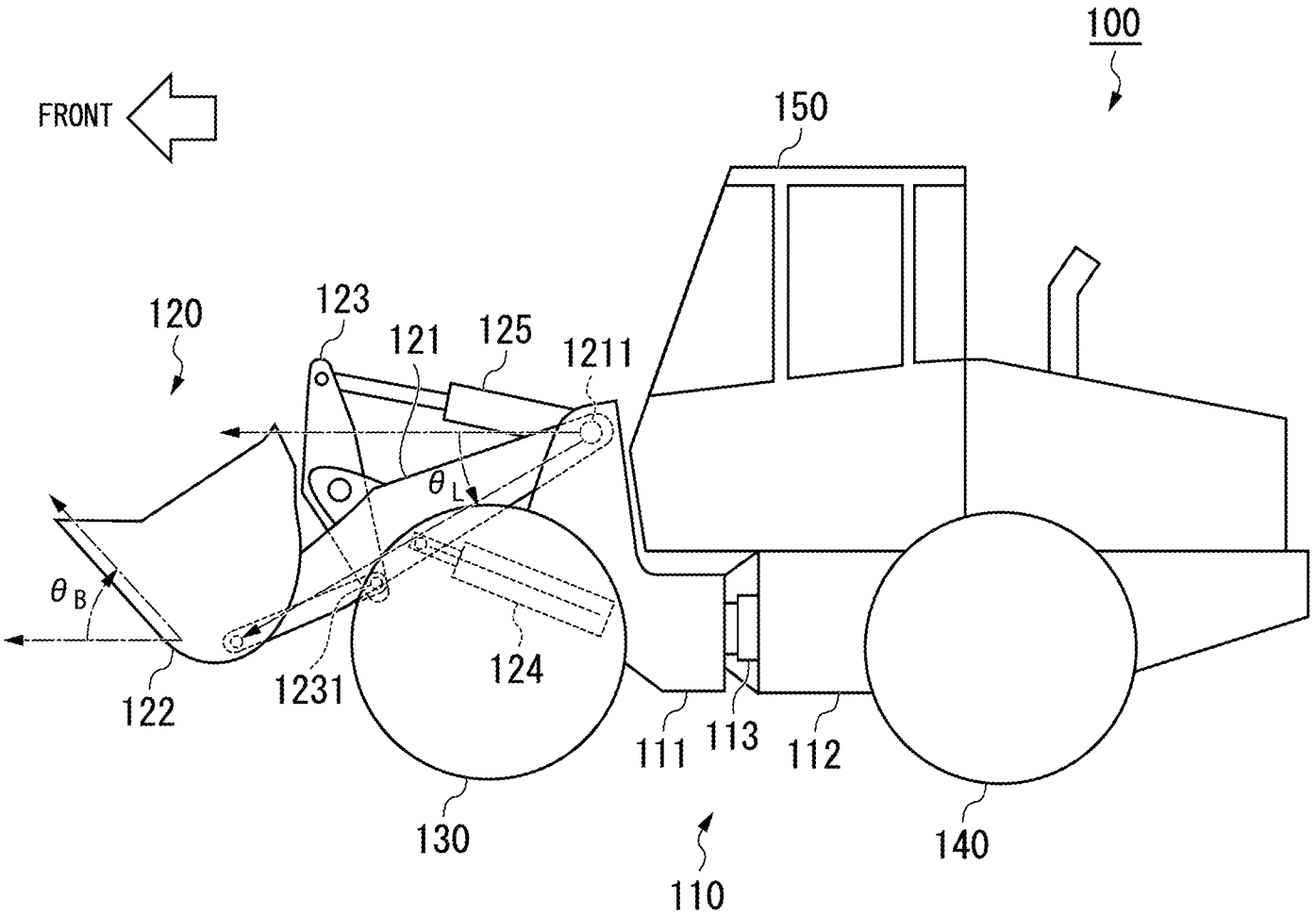
FIG. 1 is a side view of a work vehicle according to a first embodiment.

FIG. 1 is a side view of a work vehicle according to a first embodiment.

The work vehicle 100 according to the first embodiment is a wheel loader. The work vehicle 100 includes a vehicle body 110, work equipment 120, a front wheel portion 130, a rear wheel portion 140, and a cab 150.

The vehicle body 110 includes a front vehicle body 111, a rear vehicle body 112, and a steering cylinder 113. The front vehicle body 111 and the rear vehicle body 112 are rotatably attached around a steering shaft extending in an upward-downward direction of the vehicle body 110. The front wheel portion 130 is provided below the front vehicle body 111, and the rear wheel portion 140 is provided below the rear vehicle body 112.

The steering cylinder 113 is a hydraulic cylinder. A base end portion of the steering cylinder 113 is attached to the rear vehicle body 112, and a tip end portion of the steering cylinder 113 is attached to the front vehicle body 111. The steering cylinder 113 expands and contracts with a hydraulic oil to regulate an angle formed between the front vehicle body 111 and the rear vehicle body 112. That is, the steering angle of the front wheel portion 130 is regulated by expansion and contraction of the steering cylinder 113.

The work equipment 120 is used for excavating and transporting a work object such as earth. The work equipment 120 is provided at a front portion of the vehicle body 110. The work equipment 120 includes a boom 121, a bucket 122, a bell crank 123, a lift cylinder 124, and a bucket cylinder 125.

A base end portion of the boom 121 is attached to a front portion of the front vehicle body 111 via a pin. A boom angle sensor 1211 for detecting a boom angle $\theta_B$ is provided in the base end portion of the boom 121. The boom angle $\theta_B$ is represented by an angle formed between a straight line extending forward from the vehicle body 110 and a straight line extending from the base end portion to a tip end portion of the boom 121. As the boom angle $\theta_B$ increases, the position of the tip end of the boom 121 becomes higher. As the boom angle $\theta_B$ decreases, the position of the tip end of the boom 121 becomes lower. In another embodiment, a lift cylinder stroke sensor for measuring a stroke amount of the lift cylinder 124 may be provided, and the boom angle $\theta_B$ may be detected based on the stroke amount of the lift cylinder 124.

The bucket 122 includes a blade for excavating the work object and a container for transporting the excavated work object. A base end portion of the bucket 122 is attached to the tip end portion of the boom 121 via a pin.

The bell crank 123 transmits the power of the bucket cylinder 125 to the bucket 122. A first end of the bell crank 123 is attached to a bottom portion of the bucket 122 via a link mechanism. A second end of the bell crank 123 is attached to a tip end portion of the bucket cylinder 125 via a pin. A bucket angle sensor 1231 for detecting a bucket angle $\theta_B$ is provided in a central portion of the bell crank 123. The bucket angle $\theta_B$ is represented by an angle formed between the straight line extending forward from the vehicle body 110 and a straight line extending along a bottom surface of the bucket 122. When the bucket angle $\theta_B$ is positive, the bucket 122 is tilted to a tilt side, and when the bucket angle $\theta_B$ is negative, the bucket 122 is tilted to a dump side. The bucket angle $\theta_B$ is obtained by adding the boom angle $\theta_L$ to an angle of the bucket 122 with reference to the boom 121 which is obtained from the measurement value of the bucket angle sensor 1231.

The lift cylinder 124 is a hydraulic cylinder. A base end portion of the lift cylinder 124 is attached to the front portion of the front vehicle body 111. A tip end portion of the lift cylinder 124 is attached to the boom 121. As the lift cylinder 124 expands and contracts with the hydraulic oil, the boom 121 is driven in a raising direction or a lowering direction.

The bucket cylinder 125 is a hydraulic cylinder. A base end portion of the bucket cylinder 125 is attached to the front portion of the front vehicle body 111. The tip end portion of the bucket cylinder 125 is attached to the bucket 122 via the bell crank 123. As the bucket cylinder 125 expands and contracts with the hydraulic oil, the bucket 122 is driven in a tilt direction or a dump direction.

The cab 150 is a space for an operator to board and operate the work vehicle 100. The cab 150 is provided above the rear vehicle body 112.

Figure 2:
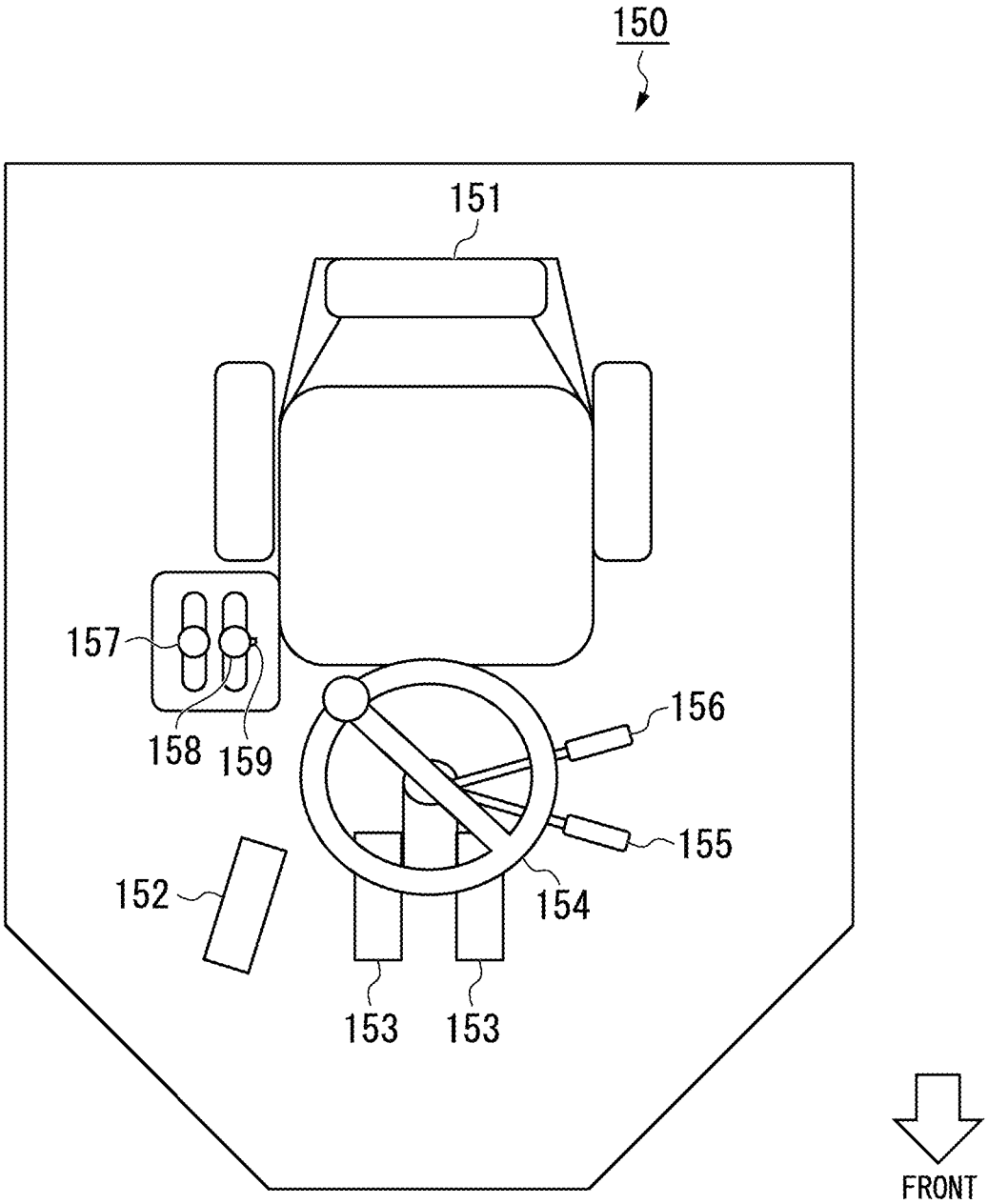
FIG. 2 is a top view showing an internal configuration of a cab according to the first embodiment.

FIG. 2 is a top view showing an internal configuration of the cab according to the first embodiment. Inside the cab 150, a seat 151, an accelerator pedal 152, a brake pedal 153, a steering wheel 154, a forward and rearward movement changeover switch 155, a shift switch 156, a boom lever 157, a bucket lever 158, and a stop switch 159 are provided.

The accelerator pedal 152 is operated to set a driving force (traction force) in traveling which is generated in the work vehicle 100.

The brake pedal 153 is operated to set a braking force in traveling which is generated in the work vehicle 100.

The steering wheel 154 is operated to set the steering angle of the work vehicle 100.

The forward and rearward movement changeover switch 155 is operated to set a traveling direction of the work vehicle 100.

The shift switch 156 is operated to set a speed range of a power transmission device.

The boom lever 157 is operated to set a speed of a raising operation or a lowering operation of the boom 121. The lowering operation is performed when the boom lever 157 is tilted forward and the raising operation is performed when the boom lever 157 is tilted rearward. Hereinafter, the raising operation and the lowering operation of the boom 121 will be referred to as a lift operation. In addition, when the boom lever 157 is tilted forward by a certain angle or larger, a start command of automatic drive control (automatic lowering control) for automatically driving the boom 121 to a predetermined lowering position is output to the control device 300. When the boom lever 157 is tilted rearward by a certain angle or larger, a start command of automatic drive control (automatic raising control) for automatically driving the boom 121 to a predetermined raising position is output to the control device 300. For example, the lowering position may be a position when the lift cylinder 124 contracts to the maximum, or a position corresponding to a ground contact height of the work vehicle 100. For example, the raising position may be a position when the lift cylinder 124 expands to the maximum. In addition, the lowering position and the raising position may be optionally set by an operator. The raising position and the lowering position are not limited to the above-described examples. However, in either case, the raising position is set above the lowering position in a vehicle body coordinate system.

The boom lever 157 returns to a neutral position after outputting the start command of the automatic drive control. In another embodiment, a position of the boom lever 157 may be fixed after outputting the start command of the automatic drive control until the automatic drive control ends. Even when the boom lever 157 is fixed, the operator can unfix the boom lever 157 by operating the boom lever 157.

The bucket lever 158 is operated to set a speed of a dump operation or a tilt operation of the bucket 122. The dump operation is performed when the bucket lever 158 is tilted forward and the tilt operation is performed when the bucket lever 158 is tilted rearward. In addition, when the bucket lever 158 is tilted forward by a certain angle or larger, a start command of automatic drive control (automatic dump control) for automatically driving the bucket 122 to a predetermined dump angle is output to the control device 300. When the bucket lever 158 is tilted rearward by a certain angle or larger, a start command of automatic drive control (automatic tilt control) for automatically driving the bucket 122 to a predetermined tilt angle is output to the control device 300. For example, the dump angle may be an angle tilted in the dump direction by a predetermined angle with respect to the horizontal direction. For example, the tilt angle may be an angle tilted in the tilt direction by a predetermined angle with respect to the horizontal direction. The dump angle and the tilt angle may be optionally set by the operator. The dump angle and the tilt angle are not limited to the above-described examples. In addition, the dump angle and the tilt angle may be the same angle (for example, both are horizontal).

The bucket lever 158 returns to a neutral position after outputting the start command of the automatic drive control. In another embodiment, a position of the bucket lever 158 may be fixed after outputting the start command of the automatic drive control until the automatic drive control ends. Even when the bucket lever 158 is fixed, the operator can unfix the bucket lever 158 by operating the bucket lever 158.

The stop switch 159 is operated to stop the various types of automatic drive control. When the stop switch 159 is pressed, a stop command is output to the control device 300. For example, the stop switch 159 is provided in the bucket lever 158.

(Power System)

Figure 3:
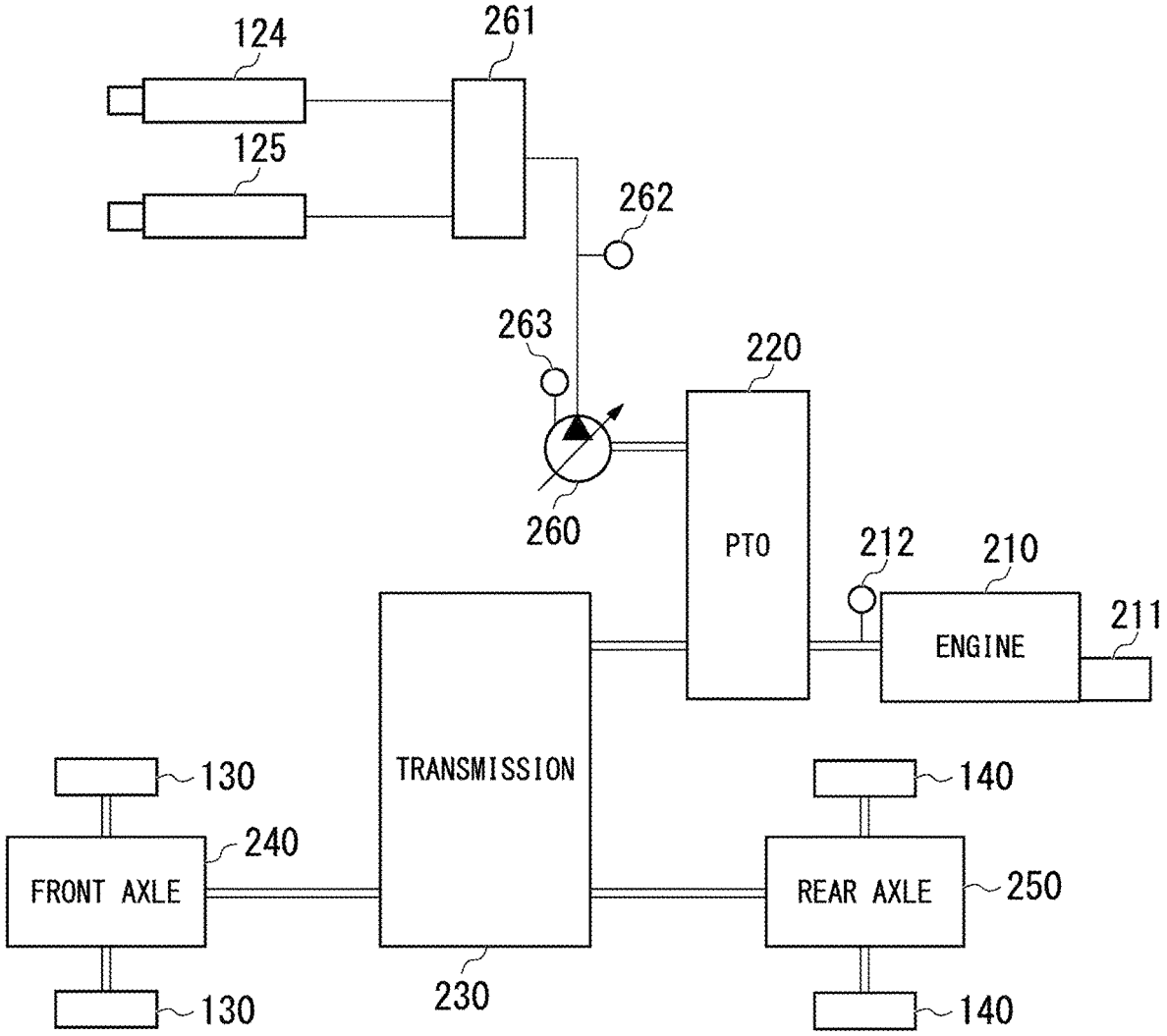
FIG. 3 is a schematic view showing a power system of the work vehicle according to the first embodiment.

FIG. 3 is a schematic view showing a power system of the work vehicle according to the first embodiment.

The work vehicle 100 includes an engine 210, a power take-off 220 (PTO), a transmission 230, a front axle 240, a rear axle 250, and a variable capacity pump 260.

The engine 210 is, for example, a diesel engine. The engine 210 is provided with a fuel injection device 211 and an engine tachometer 212. The fuel injection device 211 controls a driving force of the engine 210 by adjusting the amount of fuel which is injected into a cylinder of the engine 210. The engine tachometer 212 measures a rotational speed of the engine 210.

The PTO 220 transmits a part of the driving force of the engine 210 to the variable capacity pump 260. That is, the PTO 220 distributes the driving force of the engine 210 to the transmission 230 and the variable capacity pump 260.

The transmission 230 shifts the driving force which is input to an input shaft thereof and outputs the shifted driving force from an output shaft thereof. The input shaft of the transmission 230 is connected to the PTO 220, and the output shaft of the transmission 230 is connected to the front axle 240 and the rear axle 250. That is, the transmission 230 transmits the driving force of the engine 210 which is distributed by the PTO 220 to the front axle 240 and the rear axle 250.

The front axle 240 transmits the driving force output by the transmission 230 to the front wheel portion 130. As a result, the front wheel portion 130 is rotated.

The rear axle 250 transmits the driving force output by the transmission 230 to the rear wheel portion 140. As a result, the rear wheel portion 140 is rotated.

The variable capacity pump 260 is driven by the driving force from the engine 210. The hydraulic oil discharged from the variable capacity pump 260 is supplied to the lift cylinder 124 and the bucket cylinder 125 via a control valve 261. The variable capacity pump 260 is provided with a pump pressure gauge 262 and a pump capacity meter 263. The pump pressure gauge 262 measures a discharge pressure of the hydraulic oil discharged from the variable capacity pump 260. The pump capacity meter 263 measures the capacity of the variable capacity pump 260 based on a swash plate angle of the variable capacity pump 260.

The control valve 261 controls the flow rate of the hydraulic oil discharged from the variable capacity pump 260, and distributes the hydraulic oil to the lift cylinder 124 and the bucket cylinder 125.

(Control Device)

The work vehicle 100 includes a control device 300 for controlling the work vehicle 100. The control device 300 is an example of a work equipment control device.

The control device 300 outputs a control signal to the control valve 261 in accordance with an operation amount of each of the boom lever 157 and the bucket lever 158, or in accordance with a command of the automatic drive control input by the operator.

Figure 4:
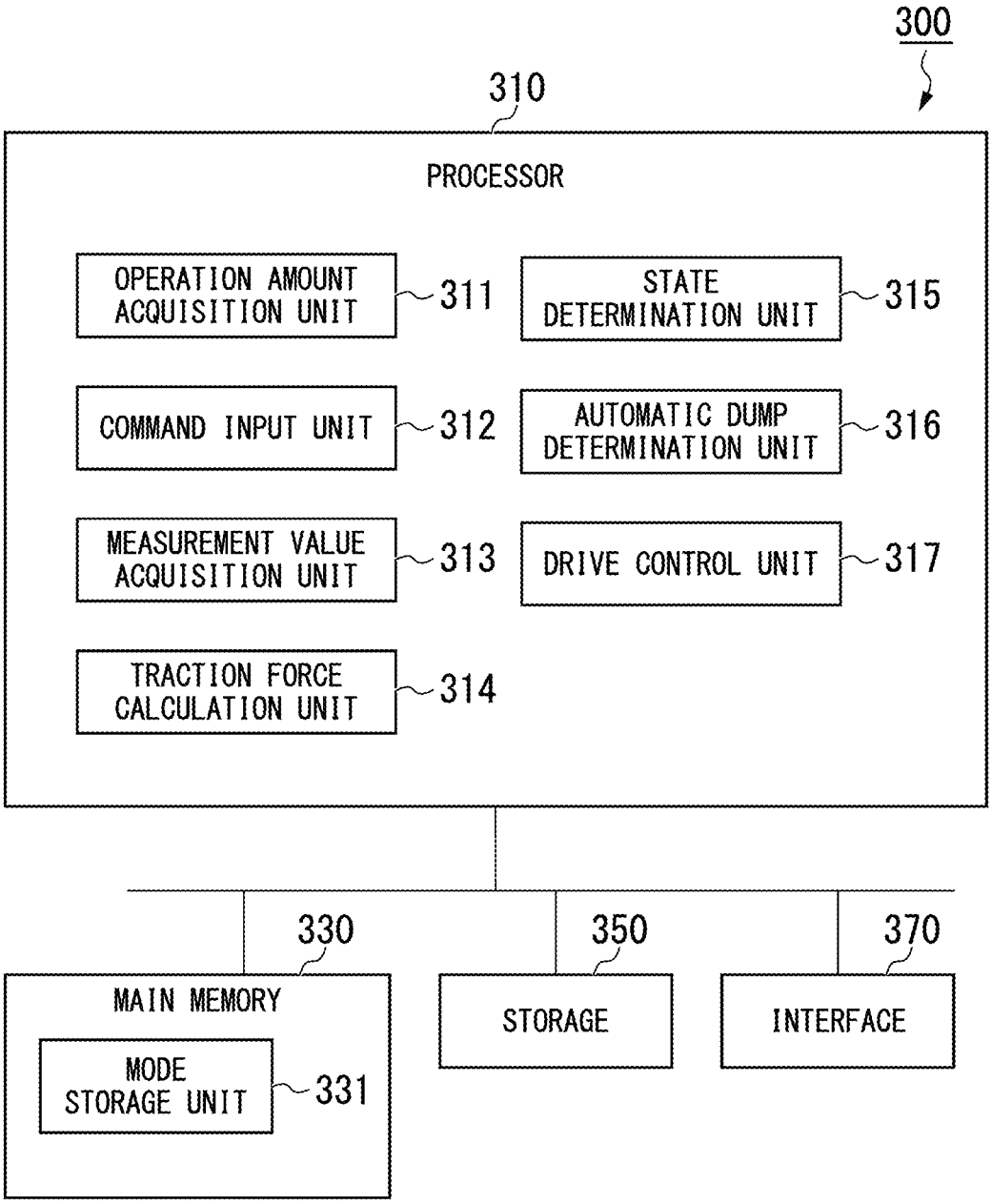
FIG. 4 is a schematic block diagram showing a configuration of a control device of the work vehicle according to the first embodiment.

FIG. 4 is a schematic block diagram showing a configuration of the control device of the work vehicle according to the first embodiment. The control device 300 is a computer including a processor 310, a main memory 330, a storage 350, and an interface 370.

The storage 350 is a non-transitory tangible storage medium. Examples of the storage 350 include a magnetic disk, a magneto-optical disk, a semiconductor memory, and the like. The storage 350 may be internal media directly connected to a bus of the control device 300 or external media connected to the control device 300 via the interface 370 or a communication line. The storage 350 stores a program for controlling the work vehicle 100.

The program may be for realizing some of the functions exhibited in the control device 300. For example, the program may exhibit its functions in combination with another program previously stored in the storage or in combination with another program mounted on another device. In another embodiment, the computer may include a custom large-scale integrated circuit (LSI) such as a programmable logic device (PLD) in addition to the above-described configuration or instead of the above-described configuration. Examples of the PLD include a programmable array logic (PAL), a generic array logic (GAL), a complex programmable logic device (CPLD), and a field-programmable gate array (FPGA). In this case, some or all of the functions which are realized by the processor may be realized by the integrated circuit.

In a case where the program is distributed to the control device 300 via the communication line, the control device 300 having received the distributed program may deploy the program in the main memory 330 and execute the above-described process.

Further, the program may be for realizing some of the above-described functions. Further, the program may be a so-called difference file (difference program) that realizes the above-described functions in combination with another program previously stored in the storage 350.

The processor 310 executes the program to include an operation amount acquisition unit 311, a command input unit 312, a measurement value acquisition unit 313, a traction force calculation unit 314, a state determination unit 315, an automatic dump determination unit 316, and a drive control unit 317.

In addition, the processor 310 executes the program so that the main memory 330 secures a storage region of a mode storage unit 331. The mode storage unit 331 stores an automatic dump availability mode indicating the availability in performing the automatic dump control. The automatic dump availability mode has a value of either an automatic dump permission mode permitting the automatic dump control to be performed or an automatic dump prohibition mode prohibiting the automatic dump control from being performed.

The operation amount acquisition unit 311 acquires the operation amounts of the boom lever 157 and the bucket lever 158.

The command input unit 312 receives an input of the start command of the automatic drive control from the boom lever 157 and the bucket lever 158. In addition, the command input unit 312 receives an input of the stop command of the automatic drive control from the stop switch 159.

The measurement value acquisition unit 313 acquires measurement values from the fuel injection device 211, the engine tachometer 212, the pump pressure gauge 262, the pump capacity meter 263, the boom angle sensor 1211, and the bucket angle sensor 1231. That is, the measurement value acquisition unit 313 acquires measurement values of a fuel injection amount of the fuel injection device 211, the rotational speed of the engine 210, the discharge pressure of the variable capacity pump 260, the capacity of the variable capacity pump 260, the boom angle $\theta_L$, and the bucket angle $\theta_B$.

The traction force calculation unit 314 calculates a traction force of the work vehicle 100 based on the measurement values acquired by the measurement value acquisition unit 313.

For example, in a case where the transmission 230 is a continuously variable transmission, the traction force calculation unit 314 can calculate the traction force by the following procedure. The traction force calculation unit 314 calculates an output torque of the engine 210 from the measurement values of the fuel injection amount and the rotational speed of the engine 210. In addition, the traction force calculation unit 314 calculates a load torque of the variable capacity pump 260 from the discharge pressure and the capacity of the variable capacity pump 260. The traction force calculation unit 314 calculates the traction force by multiplying a traveling torque, which is obtained by subtracting the load torque from the output torque, by a reduction ratio of the transmission 230, a reduction ratio of the axle, and torque efficiency, and dividing the multiplied one by an effective diameter of a wheel.

For example, in a case where the transmission 230 is a torque converter, the traction force calculation unit 314 can calculate the traction force by the following procedure. The traction force calculation unit 314 calculates a traveling torque by dividing the rotational speed of the engine 210 by 1,000 rpm and multiplying a squared value of the divided one by a primary torque coefficient and a torque ratio of the transmission 230. The primary torque coefficient and the torque ratio are characteristic values determined by an input/output rotation ratio of the transmission 230. The traction force calculation unit 314 calculates the traction force by multiplying the traveling torque by the reduction ratio of the transmission 230, the reduction ratio of the axle, and the torque efficiency, and dividing the multiplied one by the effective diameter of the wheel.

The state determination unit 315 determines a work state of the work vehicle 100 based on the traction force calculated by the traction force calculation unit 314, the measurement values of the boom angle $\theta_L$ and the bucket angle $\theta_B$ which are acquired by the measurement value acquisition unit 313, and the operation amounts of the boom lever 157 and the bucket lever 158 which are acquired by the operation amount acquisition unit 311. The work state includes at least an excavation state and a dump state.

Specifically, the state determination unit 315 determines that the work state is the excavation state when the traction force is equal to or greater than a traction force threshold, the boom angle $\theta_L$ is equal to or smaller than a boom angle threshold, the bucket angle $\theta_B$ falls within a bucket angle range, and a raising operation of the boom lever or a tilt operation of the bucket lever is continued for a certain period of time. The traction force threshold is a threshold corresponding to the traction force exerted during the excavation. The boom angle threshold is a threshold corresponding to the boom angle $\theta_L$ when the base end portion of the bucket 122 is located at a position higher than the ground contact height by a predetermined allowable height. That is, when the boom angle $\theta_L$ is equal to or smaller than the boom angle threshold, the bucket 122 is located within a predetermined height range including the ground contact height. The height range may not have a lower limit. The bucket angle range is a range including 0 degrees. That is, when the bucket angle $\theta_B$ falls within the bucket angle range, the bottom surface of the bucket 122 is substantially parallel to a forward direction of the vehicle body 110.

In addition, the state determination unit 315 determines that the work state is the dump state when the bucket angle $\theta_B$ is smaller than a predetermined dump threshold. The dump threshold is a negative value, and is a value lower than a lower limit value of the bucket angle range. That is, when the bucket angle $\theta_B$ is smaller than the dump threshold, the bottom surface of the bucket 122 is tilted in the dump direction.

When the work state of the work vehicle 100 is the excavation state, a work object is accommodated in the bucket 122. On the other hand, when the work state of the work vehicle 100 is the dump state, the work object is dumped from the bucket 122, and the work object is not accommodated in the bucket 122. That is, there is a high possibility that the work object may be accommodated in the bucket 122 after the work state is the excavation state until the work state is the dump state. On the other hand, there is a high possibility that the work object may not be accommodated in the bucket 122 after the work state is the dump state until the work state is the excavation state.

The automatic dump determination unit 316 rewrites a value of the automatic dump availability mode stored in the mode storage unit 331 to the automatic dump prohibition mode when it is determined that the work state is the excavation state. On the other hand, the automatic dump determination unit 316 rewrites the value of the automatic dump availability mode stored in the mode storage unit 331 to the automatic dump permission mode when it is determined that the work state is the dump state.

When the drive control unit 317 receives the start command of the automatic drive control, the drive control unit 317 generates a drive signal relating to the automatic drive control, and outputs the drive signal to the control valve 261. However, when the start command relating to the automatic dump control is received, the drive control unit 317 outputs the drive signal relating to the automatic dump control to the control valve 261, only when the value of the automatic dump availability mode stored in the mode storage unit 331 is the automatic dump permission mode.

In addition, when the automatic drive control is not performed, the drive control unit 317 generates a drive signal corresponding to the operation amounts of the boom lever 157 and the bucket lever 158, and outputs the drive signal to the control valve 261.

(Setting of Automatic Dump Availability Mode)

Figure 5:
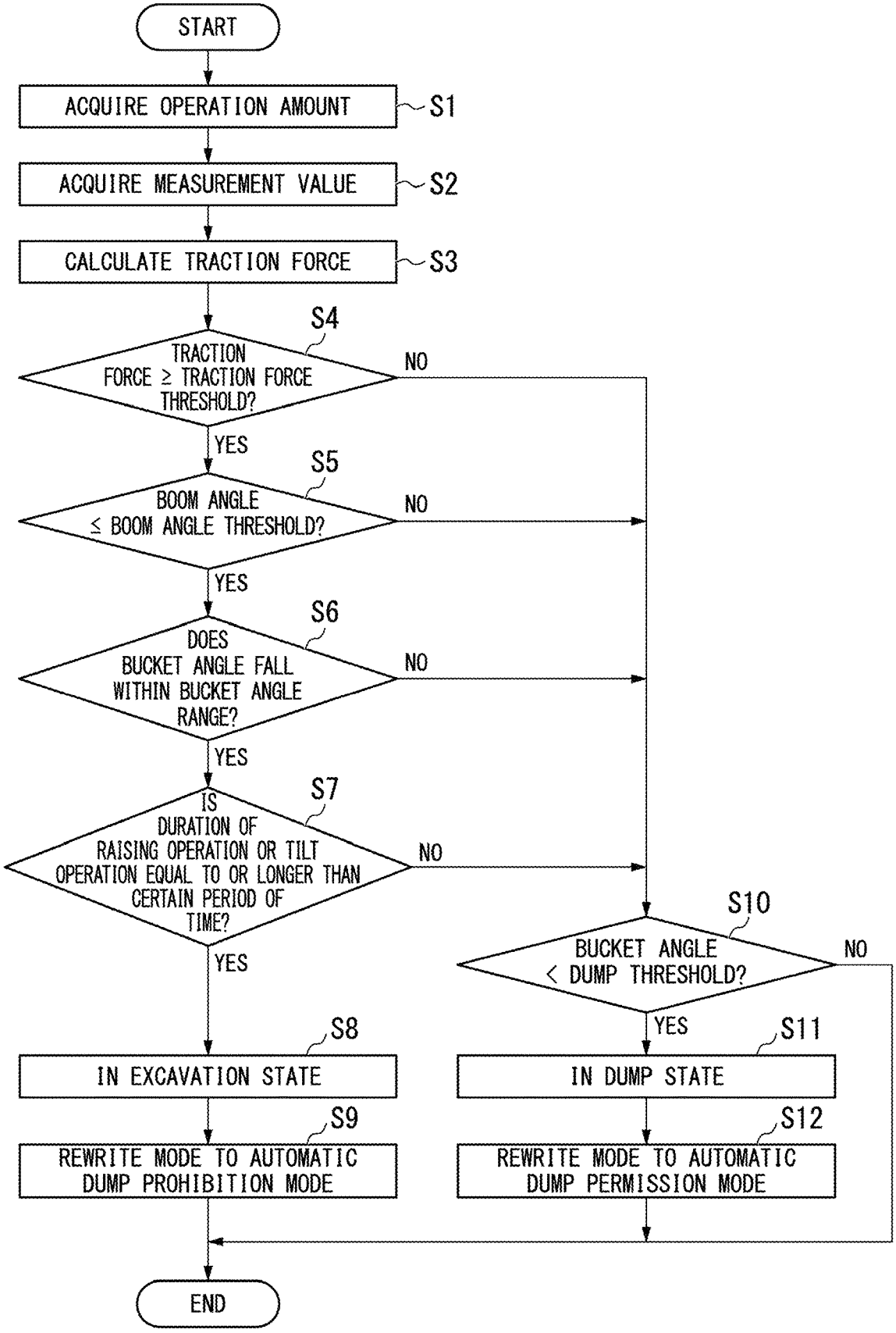
FIG. 5 is a flowchart showing a method of setting an automatic dump availability mode by the control device according to the first embodiment.

FIG. 5 is a flowchart showing a method of setting the automatic dump availability mode by the control device according to the first embodiment.

The control device 300 performs a process of setting the automatic dump availability mode described below, every predetermined control cycle.

First, the operation amount acquisition unit 311 acquires the operation amounts of the boom lever 157 and the bucket lever 158 (Step S1). In addition, the measurement value acquisition unit 313 acquires the measurement values from the fuel injection device 211, the engine tachometer 212, the pump pressure gauge 262, the pump capacity meter 263, the boom angle sensor 1211, and the bucket angle sensor 1231 (Step S2).

Next, the traction force calculation unit 314 calculates the traction force of the work vehicle 100 based on the measurement values acquired in Step S2 (Step S3). The state determination unit 315 determines whether or not the traction force calculated in Step S3 is equal to or greater than the traction force threshold (Step S4). When the traction force is equal to or greater than the traction force threshold (Step S4: YES), the state determination unit 315 determines whether or not the boom angle $\theta_L$ acquired in Step S2 is equal to or smaller than the boom angle threshold (Step S5). When the boom angle $\theta_L$ is equal to or smaller than the boom angle threshold (Step S5: YES), the state determination unit 315 determines whether or not the bucket angle $\theta_B$ acquired in Step S2 falls within the bucket angle range (Step S6). When the bucket angle $\theta_B$ falls within the bucket angle range (Step S6: YES), the state determination unit 315 determines whether or not a duration of the raising operation of the boom 121 or the tilt operation of the bucket 122 is equal to or longer than the certain period of time based on the operation amount of the boom lever 157 or the bucket lever 158 acquired in Step S1 (Step S7).

When the traction force is equal to or greater than the traction force threshold, the boom angle $\theta_L$ equal to or smaller than the boom angle threshold, the bucket angle $\theta_B$ falls within the bucket angle range, and the duration of the raising operation of the boom 121 or the tilt operation of the bucket 122 is equal to or longer than the certain period of time (Step S7: YES), the state determination unit 315 determines that the work state is the excavation state (Step S8). When the state determination unit 315 determines that the work state is the excavation state, the automatic dump determination unit 316 rewrites the value of the automatic dump availability mode stored in the mode storage unit 331 to the automatic dump prohibition mode, and ends the process (Step S9).

On the other hand, when the traction force is smaller than the traction force threshold (Step S4: NO), when the boom angle $\theta_L$ is greater than the boom angle threshold (Step S5: NO), when the bucket angle $\theta_B$ is out of the bucket angle range (Step S6: NO), or when the duration of the raising operation of the boom 121 and the tilt operation of the bucket 122 is shorter than the certain period of time (Step S7: NO), the state determination unit 315 determines whether or not the bucket angle $\theta_B$ is smaller than the dump threshold (Step S10). When the bucket angle $\theta_B$ is smaller than the dump threshold (Step S10: YES), the state determination unit 315 determines that the work state is the dump state (Step S11). When the state determination unit 315 determines that the work state is the dump state, the automatic dump determination unit 316 rewrites the value of the automatic dump availability mode stored in the mode storage unit 331 to the automatic dump permission mode, and ends the process (Step S12).

The control device 300 updates the value of the automatic dump availability mode stored in the mode storage unit 331 by performing the above-described process of setting the automatic dump availability mode, every predetermined control cycle.

(Automatic Drive Control)

Figure 6:
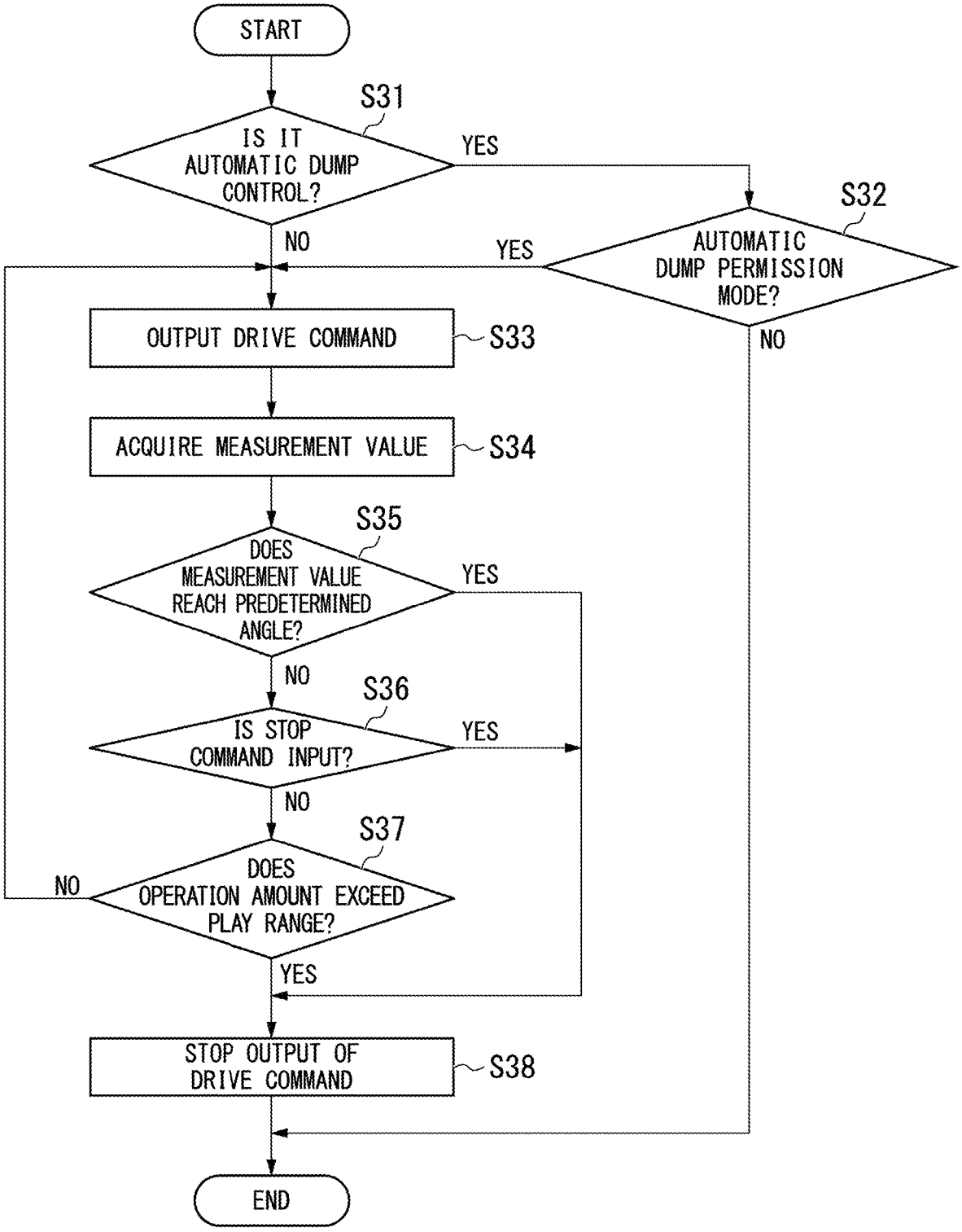
FIG. 6 is a flowchart showing an automatic drive control method by the control device according to the first embodiment.

FIG. 6 is a flowchart showing an automatic drive control method by the control device according to the first embodiment.

When the command input unit 312 receives an input of the start command of the automatic drive control, the control device 300 performs the automatic drive control described below. First, the drive control unit 317 determines whether or not the input start command is a start command relating to the automatic dump control (Step S31).

When the start command relating to automatic dump control is input (Step S31: YES), the drive control unit 317 determines whether or not the value of the automatic dump availability mode stored in the mode storage unit 331 is the automatic dump permission mode (Step S32). When the value of the automatic dump availability mode is the automatic dump prohibition mode (Step S32: NO), the drive control unit 317 ends the process without performing the automatic dump control.

On the other hand, when the start command relating to automatic raising control, automatic lowering control, or automatic tilt control is input (Step S31: NO), or when the value of the automatic dump availability mode is the automatic dump permission mode (Step S32: YES), the drive control unit 317 outputs a drive command relating to a predetermined drive speed to the control valve 261 (Step S33).

The measurement value acquisition unit 313 acquires the measurement values from the boom angle sensor 1211 and the bucket angle sensor 1231 (Step S34). The drive control unit 317 determines whether or not an angle of a control object (the boom 121 or the bucket 122) reaches a predetermined angle (rising angle, lowering angle, tilt angle, or dump angle) (Step S35). When the angle of the control object does not reach the predetermined angle (Step S35: NO), the command input unit 312 determines whether or not an input of the stop command is received (Step S36). When the stop command is not input (Step S36: NO), the operation amount acquisition unit 311 determines whether or not the operation amount of the operation lever (the boom lever 157 or the bucket lever 158) relating to the automatic drive control, which has returned to a predetermined play range immediately after the start command is input, exceeds the predetermined play range again (Step S37). When the operation amount of the operation lever does not exceed the play range (Step S37: NO), the process returns to Step S33, and the output of the drive command is continued. In another embodiment, when the operation lever is fixed after the start command of the automatic drive is input, in Step S37, the operation amount acquisition unit 311 may determine whether or not the operation amount of the operation lever falls within a range in which the operation lever is unfixed.

On the other hand, when the angle of the control object reaches the predetermined angle (Step S35: YES), when the stop command is input (Step S36: YES), and when the operation amount of the operation lever relating to the automatic drive control exceeds the play range (Step S37: YES), the drive control unit 317 stops the output of the drive command to the control valve 261 (Step S38), and ends the process.

(Operational Effect)

As described above, the control device 300 according to the first embodiment determines the work state of the work vehicle 100 based on the traction force of the work vehicle 100 and the posture of the work equipment 120, and determines the automatic dump availability mode in accordance with the work state. As a result, the control device 300 can prevent the work object from falling due to the automatic drive control.

More specifically, the control device 300 switches the automatic dump availability mode to the automatic dump prohibition mode when it is determined that the work state is the excavation state. When the work vehicle 100 carries out the excavation work, the work object is accommodated in the bucket 122 thereafter. The control device 300 can prevent the work object from falling due to the automatic drive control by switching the automatic dump availability mode to the automatic dump prohibition mode after the work state becomes the excavation state.

In addition, the control device 300 according to the first embodiment switches the automatic dump availability mode to the automatic dump permission mode when it is determined that the work state is the dump state. When the work vehicle 100 performs the dump operation, the work object is unloaded from the bucket 122, and thereafter, there is no work object in the bucket 122. Since the control device 300 switches the automatic dump availability mode to the automatic dump permission mode after the work state becomes the dump state, the control device 300 can receive the automatic drive control in a state where there is a low possibility that the work object may fall.

In the control device 300 according to the first embodiment, conditions for determining that the work state is the excavation state include the traction force being equal to or greater than the predetermined threshold. The reason is as follows. The traction force during the excavation work is stronger than that when the work vehicle 100 does not carry out the excavation work since the work vehicle 100 moves forward in a state where the bucket 122 is inserted into the work object. In addition, in the control device 300 according to the first embodiment, the conditions for determining that the work state is the excavation state include the bucket angle $\theta_B$ falling within the bucket angle range, and the height of the bucket 122 falling within the predetermined height range including the ground contact height of the work vehicle 100. The reason is as follows. When the excavation starts, an operator changes the posture of the bucket 122 to a posture in which the bottom surface of the bucket 122 is aligned along the ground surface. In addition, in the control device 300 according to the first embodiment, the conditions for determining that the work state is the excavation state include the operation of the operation device of the work equipment 120 being continued for a certain period of time. The reason is as follows. During the excavation, it is necessary to tilt the bucket 122 while raising the boom 121.

In another embodiment, the conditions for determining that the work state is the excavation state may not include the operation of the operation device of the work equipment 120 being continued for a certain period of time. For example, in another embodiment, alternatively, the conditions for determining that the work state is the excavation state may include the driving amount of the work equipment 120 with respect to the operation amount of the operation device of the work equipment 120 being smaller than a predetermined threshold.

In addition, the control device 300 according to the first embodiment stops the automatic drive control by pressing the stop switch 159. As a result, even when the automatic drive control is started due to an erroneous operation of the operator, the operator can easily stop the automatic drive control.

Another Embodiment

The embodiment has been described in detail above with reference to the drawings, but a specific configuration is not limited to the above-described configuration, and various design changes and the like can be made. For example, in another embodiment, the order of the above-described steps may be changed as appropriate. In addition, some steps may be executed in parallel.

The work vehicle 100 according to the above-described embodiment outputs the start command of the automatic drive control by tilting the boom lever 157 or the bucket lever 158 by a predetermined tilt angle or larger. However, the present invention is not limited to this. For example, the work vehicle 100 according to another embodiment may include a switch for instructing the start of the automatic drive control separately from the boom lever 157 and the bucket lever 158. The switch may also be used as the stop switch 159.

In addition, the work vehicle 100 according to the above-described embodiment separately includes the boom lever 157 and the bucket lever 158. However, the present invention is not limited to this. For example, in another embodiment, the work vehicle 100 may include one work equipment lever which functions as both of the boom lever 157 and the bucket lever 158.

In addition, the work vehicle 100 according to the above-described embodiment is the wheel loader. However, the present invention is not limited to this. For example, according to another embodiment, the work vehicle 100 may be a bulldozer and other work vehicles.

In addition, the work vehicle 100 according to the above-described embodiment performs the automatic drive control for each of the raising operation and the lowering operation of the boom 121 and the tilt operation and the dump operation of the bucket 122. However, the present invention is not limited to this. For example, the work vehicle 100 according to another embodiment may perform at least one automatic drive control including the automatic dump control.

In addition, the work vehicle 100 according to the above-described embodiment performs the automatic drive control on the tilt operation and the dump operation of the bucket 122 based on the bucket angle $\theta_B$. However, the present invention is not limited to this. For example, the work vehicle 100 according to another embodiment may obtain a stroke amount of the bucket cylinder 125 and may perform automatic drive control on the tilt operation and the dump operation based on the stroke amount of the bucket cylinder 125. The stroke amount of the bucket cylinder 125 may be obtained by a stroke sensor provided in the bucket cylinder 125, or may be calculated based on a measurement value of an angle sensor provided in the bell crank 123 and the boom angle $\theta_L$. In addition, due to the mechanism of the work equipment 120, when the boom 121 is driven, a bell crank angle is changed even when the bucket cylinder 125 is not driven. Therefore, the control device 300 of the work vehicle 100 previously measures the stroke amount (reference stroke amount) of the bucket cylinder 125 when the bucket 122 is in contact with the ground and performs the automatic drive control on the tilt operation and the dump operation of the bucket 122 based on a difference between the reference stroke amount and the stroke amount of the bucket cylinder 125. As a result, when the boom 121 is lowered to the vicinity of the ground surface, the bottom surface of the bucket 122 can be substantially parallel to the ground surface. In this case, the dump angle, the tilt angle, and the bucket angle range used for determining the excavation condition are converted into values of the stroke amount with respect to the reference stroke amount, and are compared therewith.

According to the above-described disclosure of the present invention, a work equipment control device prevents a work object from falling due to automatic drive control.

The invention claimed is:

1. A work equipment control device of a work vehicle including work equipment having a boom and a bucket, the work equipment control device comprising:

a memory in which a program is loaded; and a processor configured to execute the program to determine whether a start command for performing an automatic dump control that automatically drives the bucket to a predetermined dump angle has been received, upon determining that the start command has been received, determine a work state of the work vehicle based on a measurement value obtained from a sensor, determine an automatic dump availability mode indicating an availability to perform the automatic dump control in accordance with the work state, and switch the automatic dump availability mode to a mode prohibiting the automatic dump control from being performed when it is determined that the work state is an excavation state, the excavation state being a state in which the work vehicle is performing excavation work and there is a possibility that a work object in the bucket may fall due to the automatic dump control.

2. The work equipment control device according to claim 1, wherein the sensor includes a plurality of sensors configured to detect at least a traction force of the work vehicle, an angle of the bucket, and a height of the bucket, and the processor is configured to determine that the work state is the excavation state when the traction force of the work vehicle is equal to or greater than a predetermined threshold, the angle of the bucket falls within a predetermined angle range including an angle at which a bottom surface of the bucket is parallel to the work vehicle, and the height of the bucket falls within a predetermined height range including a ground contact height of the work vehicle.

3. The work equipment control device according to claim 2, wherein the processor is configured to determine that the work state is the excavation state when the traction force is equal to or greater than the predetermined threshold, the angle of the bucket falls within the predetermined angle range including the angle at which the bottom surface of the bucket is parallel to the work vehicle, the height of the bucket falls within the predetermined height range including the ground contact height of the work vehicle, and an operation of an operation device of the work equipment is continued for a certain period of time.

4. The work equipment control device according to claim 1, wherein the processor is configured to switch the automatic dump availability mode to a mode permitting the automatic dump control to be performed when it is determined that the work state is a dump state in which the work object is dumped from the bucket.

5. The work equipment control device according to claim 4, wherein the processor is configured to determine that the work state is the dump state when an angle of the bucket is tilted by a predetermined angle or larger in a dump direction from an angle parallel to the work vehicle.

6. The work equipment control device according to claim 1, wherein the processor is further configured to output a drive command relating to the automatic dump control when the start command of the automatic dump control is received and the automatic dump availability mode is a mode permitting the automatic dump control to be performed.

7. The work equipment control device according to claim 6, wherein the processor is configured to receive start commands of the automatic dump control, automatic tilt control for automatically driving the bucket to a predetermined tilt angle, automatic raising control for automatically driving the boom to a predetermined raising position, and automatic lowering control for automatically driving the boom to a predetermined lowering position, and output a drive command relating to the automatic tilt control, the automatic raising control, or the automatic lowering control, regardless of the automatic dump availability mode, when receiving the start command of the automatic tilt control, the automatic raising control, or the automatic lowering control.

8. The work equipment control device according to claim 6, wherein the processor is configured to receive a stop command when a stop switch provided in the work vehicle is pressed, and stop an output of the drive command when receiving the stop command.

9. A work vehicle including the work equipment control device according to claim 1, the work vehicle further comprising:

work equipment having the boom and the bucket.

10. The work equipment control device according to claim 1, wherein the start command is generated in response to an operation performed by an operator.

11. The work equipment control device according to claim 10, wherein the operation performed by the operator includes tilting a bucket operation lever by a prescribed angle or larger.

12. A method for controlling work equipment of a work vehicle, the work equipment having a boom and a bucket, the method comprising:

determining whether a start command for performing an automatic dump control that automatically drives the bucket to a predetermined dump angle has been received;

upon determining that the start command has been received, determining a work state of the work vehicle based on a measurement value obtained from a sensor; and determining an automatic dump availability mode indicating availability in performing the automatic dump control in accordance with the work state;

the determining the automatic dump availability mode includes switching the automatic dump availability mode to a mode prohibiting the automatic dump control from being performed when it is determined that the work state is an excavation state, the excavation state being a state in which the work vehicle is performing excavation work and there is a possibility that a work object in the bucket may fall due to the automatic dump control.

* * * * *